US008402780B2

(12) United States Patent
Wiggs

(10) Patent No.: US 8,402,780 B2
(45) Date of Patent: Mar. 26, 2013

(54) OIL RETURN FOR A DIRECT EXCHANGE GEOTHERMAL HEAT PUMP

(75) Inventor: B. Ryland Wiggs, Franklin, TN (US)

(73) Assignee: Earth to Air Systems, LLC, Franklin, TN (US)

( * ) Notice: Subject to any disclaimer, the term of this patent is extended or adjusted under 35 U.S.C. 154(b) by 902 days.

(21) Appl. No.: 12/435,197

(22) Filed: May 4, 2009

(65) Prior Publication Data

US 2009/0272137 A1 Nov. 5, 2009

Related U.S. Application Data

(60) Provisional application No. 61/049,960, filed on May 2, 2008, provisional application No. 61/051,156, filed on May 7, 2008.

(51) Int. Cl.
*F25B 31/00* (2006.01)
*F25B 23/00* (2006.01)
*F25B 43/02* (2006.01)

(52) U.S. Cl. ..... 62/192; 62/260; 62/470; 62/503; 62/510

(58) Field of Classification Search ..... 62/193, 62/260, 470, 503, 510
See application file for complete search history.

(56) References Cited

U.S. PATENT DOCUMENTS 2,503,456 A 4/1950 Smith
3,099,140 A 7/1963 Leimbach
3,183,675 A 5/1965 Schroeder
3,452,813 A 7/1969 Watkins et al.
3,986,345 A 10/1976 Pilz et al.
4,010,731 A 3/1977 Harrison
4,094,356 A 6/1978 Ash et al.
4,169,554 A 10/1979 Camp
4,182,133 A 1/1980 Haas et al.
4,189,848 A 2/1980 Ko et al.
4,224,805 A 9/1980 Rothwell
4,257,239 A 3/1981 Partin et al.
4,286,651 A 9/1981 Steiger et al.
4,290,266 A 9/1981 Twite et al.
4,325,228 A 4/1982 Wolf
4,375,831 A 3/1983 Downing, Jr.
4,378,787 A 4/1983 Fleischmann
4,383,419 A 5/1983 Bottum
4,392,531 A 7/1983 Ippolito
4,448,237 A 5/1984 Riley
4,448,238 A 5/1984 Singleton et al.
4,459,752 A 7/1984 Babcock
4,536,765 A 8/1985 Kaminski
4,538,673 A 9/1985 Partin et al.
4,544,021 A 10/1985 Barrett
4,586,351 A * 5/1986 Igarashi et al. ..... 62/468
4,700,550 A 10/1987 Rhodes
4,715,429 A 12/1987 Mogensen
4,741,388 A 5/1988 Kuroiwa
4,798,056 A 1/1989 Franklin
4,858,679 A 8/1989 Sakaya et al.
4,858,694 A 8/1989 Johnson et al.
4,867,229 A 9/1989 Mogensen
4,936,110 A 6/1990 Kuckens
4,993,483 A 2/1991 Harris
5,025,634 A 6/1991 Dressler (Continued)

*Primary Examiner* — Marc Norman
(74) *Attorney, Agent, or Firm* — Miller, Matthias & Hull LLP

(57) ABSTRACT

A heating/cooling system design enabling one to maintain a superheat level of more than 1 degree F. and up to 10 degrees F., incorporating a specially designed accumulator, optional special oil return means, a specially designed receiver, and, when utilized in a DX geothermal system application, a preferable sub-surface liquid refrigerant transport line insulation design, as well as a design enabling the utilization of at least two compressors to increase heat transfer temperature differentials together with special oil separators.

17 Claims, 2 Drawing Sheets

U.S. PATENT DOCUMENTS 5,025,641 A 6/1991 Broadhurst
5,029,633 A 7/1991 Mann
5,038,580 A 8/1991 Hart
5,054,297 A 10/1991 Furuhama
5,062,276 A 11/1991 Dudley
5,105,633 A 4/1992 Briggs
5,131,238 A 7/1992 Meckler
5,136,855 A 8/1992 Lenarduzzi
5,199,486 A 4/1993 Balmer et al.
5,207,075 A 5/1993 Gundlach
5,224,357 A 7/1993 Galiyano
5,272,879 A 12/1993 Wiggs
5,275,008 A 1/1994 Song et al.
5,277,032 A 1/1994 See et al.
5,313,804 A 5/1994 Kaye
5,381,672 A 1/1995 Haasis
5,383,337 A 1/1995 Baker
5,388,419 A 2/1995 Kaye
5,419,135 A 5/1995 Wiggs
5,419,157 A * 5/1995 Kiblawi et al. ..... 62/503
5,461,876 A 10/1995 Dressler
5,477,703 A 12/1995 Hanchar et al.
5,477,914 A 12/1995 Rawlings
5,533,355 A 7/1996 Rawlings
5,560,220 A 10/1996 Cochran
5,561,985 A 10/1996 Cochran
5,564,282 A 10/1996 Kaye
5,598,887 A 2/1997 Ikeda et al.
5,622,057 A 4/1997 Bussjager et al.
5,623,986 A 4/1997 Wiggs
5,651,265 A 7/1997 Grenier
5,671,608 A 9/1997 Wiggs et al.
5,706,888 A 1/1998 Ambs et al.
5,725,047 A 3/1998 Lopez
5,738,164 A 4/1998 Hildebrand
5,758,514 A 6/1998 Genung
5,771,700 A 6/1998 Cochran
5,816,314 A 10/1998 Wiggs et al.
5,875,644 A 3/1999 Ambs et al.
5,934,087 A 8/1999 Watanabe et al.
5,937,665 A 8/1999 Kiessel et al.
5,937,934 A 8/1999 Hildebrand
5,941,238 A 8/1999 Tracy
5,946,928 A 9/1999 Wiggs
6,138,744 A 10/2000 Coffee
6,212,896 B1 4/2001 Genung
6,227,003 B1 5/2001 Smolinsky
6,276,438 B1 8/2001 Amerman et al.
6,354,097 B1 3/2002 Schuster
6,390,183 B2 5/2002 Aoyagi et al.
6,450,247 B1 9/2002 Raff
6,521,459 B1 2/2003 Schooley et al.
6,615,601 B1 9/2003 Wiggs
6,751,974 B1 6/2004 Wiggs
6,789,608 B1 9/2004 Wiggs
6,892,522 B2 5/2005 Brasz et al.
6,931,879 B1 8/2005 Wiggs
6,932,149 B2 8/2005 Wiggs
6,971,248 B1 12/2005 Wiggs
7,080,524 B2 7/2006 Wiggs
7,146,823 B1 12/2006 Wiggs
7,191,604 B1 3/2007 Wiggs
7,234,314 B1 6/2007 Wiggs
7,401,641 B1 7/2008 Wiggs
7,578,140 B1 8/2009 Wiggs
7,591,145 B1 9/2009 Wiggs
2002/0132947 A1 9/2002 Smith et al.
2002/0194862 A1 12/2002 Komatsubara
2004/0000399 A1 1/2004 Gavula
2004/0129408 A1 7/2004 Wiggs
2004/0206103 A1 10/2004 Wiggs
2006/0086121 A1 4/2006 Wiggs
2006/0096309 A1 5/2006 Wiggs
2006/0196220 A1 * 9/2006 Westermeyer ..... 62/470
2007/0074847 A1 4/2007 Wiggs
2007/0089447 A1 4/2007 Wiggs
2007/0151280 A1 7/2007 Wiggs
2008/0016894 A1 1/2008 Wiggs
2008/0173425 A1 7/2008 Wiggs
2009/0065173 A1 3/2009 Wiggs
2009/0095442 A1 4/2009 Wiggs
2009/0120120 A1 5/2009 Wiggs
2009/0120606 A1 5/2009 Wiggs
2009/0133424 A1 5/2009 Wiggs
2009/0260378 A1 10/2009 Wiggs
2009/0272137 A1 11/2009 Wiggs

* cited by examiner

OIL RETURN FOR A DIRECT EXCHANGE GEOTHERMAL HEAT PUMP

CROSS-REFERENCE TO RELATED APPLICATIONS

This application claims the claims the benefit of U.S. Provisional Application No. 61/049,960, filed May 2, 2008, and U.S. Provisional Application No. 61/051,156, filed May 7, 2008.

FIELD OF THE DISCLOSURE

The present disclosure primarily relates to a geothermal direct exchange ("DX") heating/cooling system, which is also commonly referred to as a "direct exchange" and/or a "direct expansion" heating/cooling system, comprising various design improvements and various specialty applications. However, the disclosures herein can also provide design and/or efficiency enhancements for other heat pump systems, such as air-source heat pumps, water-source heat pumps, and the like.

BACKGROUND OF THE DISCLOSURE

Geothermal ground source/water source heat exchange systems typically utilize fluid-filled closed loops of tubing buried in the ground, or submerged in a body of water, so as to either absorb heat from, or to reject heat into, the naturally occurring geothermal mass and/or water surrounding the buried or submerged fluid transport tubing. The tubing loop is extended to the surface and is then used to circulate one of the naturally warmed and naturally cooled fluid to an interior air heat exchange means.

Common and older design geothermal water-source heating/cooling systems typically circulate, via a water pump, a fluid comprised of water, or water with anti-freeze, in plastic (typically polyethylene) underground geothermal tubing so as to transfer geothermal heat to or from the ground in a first heat exchange step. Via a second heat exchange step, a refrigerant heat pump system is utilized to transfer heat to or from the water. Finally, via a third heat exchange step, an interior air handler (comprised of finned tubing and a fan) is utilized to transfer heat to or from the refrigerant to heat or cool interior air space.

Newer design geothermal DX heat exchange systems, where the refrigerant fluid transport lines are placed directly in the sub-surface ground and/or water, typically circulate a refrigerant fluid, such as R-22, R-410A, or the like, in sub-surface refrigerant lines, typically comprised of copper tubing, to transfer geothermal heat to or from the sub-surface elements via a first heat exchange step. DX systems only require a second heat exchange step to transfer heat to or from the interior air space, typically by means of an interior air handler. Consequently, DX systems are generally more efficient than water-source systems because less heat exchange steps are required and because no water pump energy expenditure is necessary. Further, since copper is a better heat conductor than most plastics, and since the refrigerant fluid circulating within the copper tubing of a DX system generally has a greater temperature differential with the surrounding ground than the water circulating within the plastic tubing of a water-source system, generally, less excavation and drilling is required, and installation costs are lower, with a DX system than with a water-source system.

While most in-ground/in-water DX heat exchange designs are feasible, various improvements have been developed intended to enhance overall system operational efficiencies. Several such design improvements, particularly in direct expansion/direct exchange geothermal heat pump systems, are taught in U.S. Pat. No. 5,623,986 to Wiggs; in U.S. Pat. No. 5,816,314 to Wiggs, et al.; in U.S. Pat. No. 5,946,928 to Wiggs; in U.S. Pat. No. 6,615,601 B1 to Wiggs; and in U.S. Pat. No. 6,932,149 to Wiggs, the disclosures of which are incorporated herein by reference. Such disclosures encompass both horizontally and vertically oriented sub-surface heat geothermal heat exchange means.

In any particular DX system design, as well as in other conventional heat pump system designs, increasing system operational efficiencies and helping to protect the longevity of system operational efficiencies are of paramount importance. The subject matter disclosed herein primarily relates to DX systems and various system design improvements that will increase system operational efficiencies and help to protect the longevity of system operational efficiencies.

Useful design improvements that will increase and help to protect the longevity of system operational efficiencies in a DX system, as well as in other conventional heat pump systems, would encompass an optimum means of oil return from an optimally designed oil separator and a means of maintaining a level of more than 1 and up to 10 degrees F. superheat, as measured in the suction line to the system's compressor, in the heating mode of operation. Generally, compressor manufacturers recommend operation at about 20 degrees F. superheat, so as to protect their compressors against "slugging", occasioned by too much liquid refrigerant passing through the compressor. Slugging can damage compressors and impair operational efficiencies. To help to protect the longevity of system operational efficiencies in a DX System herein, as well as in other heat pump systems, means, among other obvious meanings, to help prevent operational efficiency degradation via at least one of short term and prolonged system operational use.

Consequently, a means to accomplish at least one of the said primary objectives would be preferable. The present disclosure provides a solution to these preferable objectives, as hereinafter more fully described.

SUMMARY OF THE DISCLOSURE

The present disclosure increases operational efficiencies and helps protect the longevity of operational efficiencies of predecessor direct expansion/direct exchange ("DX"), geothermal heating/cooling system designs, as well as of other heat pumps system designs where applicable, by providing: (1) an optimum means of oil return from an optimally designed oil separator; (2) a means of maintaining a level of about between 1 and 10 degrees F. superheat, as measured in the suction line to the system's compressor, particularly in the heating mode of operation; (3) an operable means to prevent "frosting" of an interior heat exchanger during periods of low pressure/low temperature suction line refrigerant returning from a DX system's sub-surface geothermal heat exchanger in the cooling mode; (4) to provide an optimum amount of insulation on the liquid refrigerant transport line within a well/borehole DX system design application; and (5) to provide a means of protecting metal (usually copper) heat exchange tubing within a corrosive sub-surface environment, with a minimum negative impact on geothermal heat transfer abilities of the vapor refrigerant transport line in a DX system. The objectives of this disclosure are accomplished as follows:

Oil Separator (1) An oil separator is utilized that is 99.9% efficient, such as a coalescing glass filter that filters down to 0.3 microns, and is preferable for use in a DX system, or in any other conventional heat pump system (such as an air-source heat pump, or the like (air-source heat pumps are well understood by those skilled in the art and are not shown/described in detail herein). Typical oil filters are designed to be about 80% to 90% efficient so as to keep most of the oil out of the heat transfer tubing, as too much oil on the interior walls of refrigerant transport tubing impairs heat transfer. Also, as is well understood by those skilled in the art, conventional oil separators have internal floats that seal the return oil line when the float is seated. When enough oil collects in the bottom of the oil separator, the float is lifted off its seat (on top of the oil return line) by the rising oil level, and the oil is sucked back into the compressor, via the compressor's suction, until the float falls to its normal seat on top of, and sealing off, the oil return line, all of which is well understood by those skilled in the art.

Additionally, when extensive field work is required and/or when nitrogen purging is not always provided when brazing refrigerant lines, it is preferable to oversize, by a factor of at least one and a half times, the necessary operable size (which necessary operable size is well understood by those skilled in the art) of a preferable at least approximate 98% efficient oil filter, so as to permit reasonable amounts of debris accumulation within the filter without impairing functionality. Debris is more likely to occur in a DX system installation than in a conventional system design because of potential exposure to ground/dirt and because of more than usual field installed refrigerant transport line segments. One and a half times conventional filter sizing means that if, for example, an 8 cubic inch filter were to be used for a 5 ton heat pump system, then a 12 cubic inch filter may be used for the design as disclosed herein. Both the oil separator with a float, and without a float, as hereinafter described, may each respectively have such an over-sized filter in a DX system application.

(1A) In a preferred first improved oil separator design, the oil from the separator is neither returned directly to the compressor, nor to the suction line to the accumulator, when an oil float opens, as per various prior designs. Instead, the oil is returned from an oil separator, without any float, via an oil return line. The oil return line contains at least one of a specially sized orifice and a specially sized pin restrictor (pin restrictors, which are typically used as fixed orifice expansion devices for refrigerant, are well understood by those skilled in the art), so as to meter the amount of oil flowing through the oil return line to the suction line to the accumulator, although returning the oil to the suction line to the compressor itself is an acceptable alternative when a higher compressor superheat is preferred.

The oil return line, with at least one of a specially sized orifice and a specially sized pin restrictor, may be coupled to the suction line to the compressor at a point where the suction line is proximate to the exit point of the suction line from the accumulator, as the suction line next travels to the compressor, so as to both increase compressor superheat and to reduce potential compressor frosting concerns when operating in the heating mode.

As mentioned, the oil return line preferably has at least one of a specially sized orifice and a specially sized pin restrictor. The pin restrictor has an interior orifice, as is well understood by those skilled in the art, and would be installed within conventional pin restrictor housing (which housing is well understood by those skilled in the art) in the oil return line, so as to properly control the oil return flow rate within acceptable oil flow rate parameters. The preferred orifice size would be provided by at least one of an orifice within a return tube blockage, which would be obvious to construct and a small, appropriately sized capillary tube, which would be obvious to provide, and a pin restrictor, which is shown and described herein. The oil return orifice would preferably be filtered so as to prevent clogging with even tiny debris, via a screening/netting with a mesh size as further more fully described herein.

Detailed testing has shown that the preferred oil return orifice size design, where the orifice size is based upon the overall system's compressor design capacity, would be as per the following design parameters, with the orifice size in inches rounded to the nearest thousandth:

Starting with a pin restrictor orifice diameter size of approximately 0.003225 per 1,000 BTUs up to 12,000 BTU of system compressor capacity size, which equals a diameter of approximately 0.0387 inches, which equals approximately 0.039 inches when rounded to the nearest thousandth for a 12,000 BTU compressor size, add approximately 0.000216 inches of round orifice diameter per 1,000 BTUs of system compressor size above 12,000 BTU for the appropriate pin restrictor orifice diameter size in the oil return line. Thus, for example, a 60,000 BTU system compressor would require adding the difference in 1,000 BTU increments between 60 and 12, which difference equals 48, times 0.000216 inches, which equals 0.010368 inches, to the base starting diameter of 0.39 inches (adding 0.010368 inches to 0.039 inches), to equal a pin restrictor orifice size in the oil return line of 0.049368 inches, which, rounded to the nearest thousandth, equals a 0.049 inch pin restrictor orifice diameter size, which has a round area size of 0.0018857454 inches, for a 60,000 BTU, or 5 ton, system compressor capacity design size.

The above formula is for use in conjunction with a system where the actual oil flow rate through the compressor is designed at a common oil flow rate of approximately 0.006, plus or minus approximately 0.001, of the refrigerant flow rate, in pounds, per hour. The same ratio/formula criteria, plus or minus a maximum approximate 8% allowance, would be applied to other refrigerant flow rates. If the orifice size area is too small, not enough oil will be returned to the compressor. If the orifice size area is too large, hot gas from the compressor discharge line will leak through the area and impair system operational efficiencies.

Further, testing has shown that such a preferred oil return orifice may have a filter/screen situated prior to the orifice's intake, so as filter out debris, as only a very small amount of debris could otherwise block oil return flow through the orifice. The filter may incorporate a protective screen, or the like, with a mesh size of between approximately 600 and 700 microns so as to prevent large debris from entering and potentially damaging the compressor (600 microns is about a 30 mesh screen). A smaller mesh size could impair oil return via oil that has escaped from the oil separator and has mixed with the circulating refrigerant.

As mentioned, an improved oil separator design, utilizing the above-said components, would incorporate a continuous and appropriately metered oil return flow line, without any float in the oil separator itself. Typical oil separators are well understood by those skilled in the art, and are comprised of a hot gas intake port, which receives the hot gas discharge from the compressor, as well as which receives a small amount of compressor oil, mixed with the hot discharge gas, from the compressor. Most of the oil is separated from the refrigerant via the filter within the oil separator. Most all of the oil drops through the filter into the bottom of the oil separator tank. In standard oil separator designs, when the oil level gets high enough, the rising oil causes an internal float within the oil separator to lift up off the top of an oil return line, where the oil is suctioned back into the compressor. When the oil that floated the compressor is suctioned back into the compressor, the float falls back down via gravity and blocks the flow of any hot discharge gas into the compressor via the oil return line.

However, in conventional oil separator designs, the float within the oil separator can be a weak point, as if one adds or subtracts too much pressure too quickly (such as, for example, in many common applications, adding more than approximately 50 psi per second via leak testing with dry nitrogen or via actual system refrigerant charging), or if the system experiences abnormally high pressures, the common steel float, if not strong enough, can become damaged and malfunction, resulting in at least one of a permanent blockage, a permanent opening, and a partial permanent opening, of the oil return line. Further, all commonly used oil separator floats have hinges, which periodically wear out and fail.

Any of the mentioned conventional oil separator float concerns could result in at least one of system operational impairment and a compressor burn out. Thus, a significant design improvement would consist of the utilization of an oil separator with no float, so as to eliminate the possibility of any such immediately unobservable damage. However, to utilize an oil separator with no float would require the incorporation of the other related above-said design elements, comprised of a specially sized oil metering device, or the like, with an oil return orfice filter/screen, for example.

The above-described design provides a least an approximate 98% efficient oil separation means, and the other advantages disclosed. The very minor amount of oil that escapes from the oil separator into the primary refrigerant transport lines in the heating mode will at least be washed back into the system's accumulator in the cooling mode, and thereafter returned from the accumulator to the compressor, even when a conventional accumulator is utilized. Conventional accumulator and compressor designs are well understood by those skilled in the art.

However, an extremely minor amount of oil will escape from an approximate 98% efficient oil separator. Therefore, an additional safety reservoir of oil may be added to the oil separator prior to initial system start-up. The amount of additional oil may be calculated at a volume equal to approximately 10% of the compressor manufacturer's recommended factory oil charge for the particular compressor utilized. Any escaping oil will typically eventually be returned to the system's compressor, particularly along with the liquid refrigerant when one operates in the cooling mode. For example, a Bristol Compressor Model H89A54 has a factory recommended oil charge of 65 ounces. Thus, an extra approximate 6.5 ounces may be added to the float-less oil separator.

Further, a second extra amount of oil may be added to the oil separator, prior to system start-up, in an amount that equals the amount of oil necessary to saturate the approximate 98% efficient filter during system operation. This amount will vary depending on the size of filter utilized.

Conventional accumulators have a field suction line discharging into, or near the top of, the accumulator, and an interior U bend suction line to the compressor. The U bend typically has a fully open-ended refrigerant suction tube intake within and near the top of the accumulator. At or near the base of the U bend within the accumulator, there is typically a small oil return orifice that is designed to return both oil and liquid refrigerant to the compressor, as oil is mixed with liquid refrigerant in conventional oil return designs. The subject design improvement, as explained herein and comprised of a means of returning metered, mostly all, oil from an oil separator to at least one of the accumulator and the compressor, returns mostly pure oil to at least one of the accumulator and the compressor, and alleviates the need to have as large of an orifice in the base of the accumulator, as there is now no need to have an orifice sized large enough to return an oil and liquid refrigerant mixture. By being able to at least one of eliminate and decrease the size of the oil/liquid return orifice in the base of the U bend in conventional accumulators, one reduces the amount of liquid refrigerant pulled into the compressor, which helps to at least one of prolong compressor life (as less liquid refrigerant is now within the compressor to dilute the oil pulled into the compressor bearings, which are well understood by those skilled in the art) and increase operational efficiencies.

(1B) However, in a predominantly heating mode application, where a DX system may rarely or never be used in the cooling mode, the following design improvement is a means of preventing virtually all compressor lubricating oil from reaching the sub-surface refrigerant heat exchange tubing.

This virtually all oil return means may be accomplished by utilizing at least two specially designed oil separators per individual DX system.

The at least first oil separator would be a float-less oil separator, as described and disclosed hereinabove.

The second oil separator would have the same preferable double oversized filter as the above-described float-less oil separator described above, but would have an internal float, and would be situated within the compressor discharge, high pressure, line, immediately past the first float-less oil separator in the refrigerant flow path originating from the compressor. The second oil separator would preferably have a float, so that the tiny residue of oil escaping the first float-less oil separator would have to collect to a sufficient quantity to lift the float before it was returned to the compressor. After the excess oil was returned to at least one of the accumulator's suction line and the compressor's suction line, the float in the second oil separator would close and hot gas would not be "short-circuited" back to the compressor from the second oil separator. In such a dual style oil separator design (float-less and float), one may be cautious not to pressure test or charge the system with more than 50 psi per second, so as not to damage a potentially weak float within the secondary oil separator.

The second oil separator may have design criteria, as follows:

First, it may have the same approximate 98% efficient filter as described hereinabove regarding the float-less oil separator.

Second it may have at least one sight glass in its vessel containment shell wall, positioned so that at least the minimum requisite amount of oil could always be observed.

Third, an extra amount of oil may be added to the oil separator, typically prior to system start-up, in an amount that equals the amount of oil necessary to saturate the approximate 98% efficient filter during system operation. This amount will vary depending on the size of filter utilized.

Fourth, an amount of extra oil may be added, typically prior to system start-up, so as to fill the empty bottom of the oil separator with the internal float, with an amount of oil that equals the total amount of extra oil necessary to lift the internal float off its seat (and return oil to the compressor) when no more than approximately 90% of the extra oil added to the first oil separator, and when no less than approximately 10% of the extra oil added to the first oil separator, enters into the second oil separator with a float. The extra amount of oil added to the second oil separator with the float will equal the amount of oil that equals the total amount of extra oil necessary to lift the internal float off its seat (and return oil to the compressor) when approximately 50% of the extra oil added to the first float-less oil separator enters into the second oil separator with a float, so as neither to require operation of the second oil separator too frequently, or too infrequently.

Using the above example, where Bristol Compressor Model H89A54 has a factory recommended oil charge of 65 ounces, and an extra 6.5 ounces is added to the first float-less oil separator, one would keep the extra oil level required to be added in the second oil separator with a float to an amount where the float would engage and lift when no more than 5.85 ounces, no less than 0.715 ounces, and preferably 3.25 ounces entering the secondary oil separator would cause the float to rise, resulting in the return of oil that escaped the first float-less oil separator.

Lastly, such a specially designed secondary oil separator with a float may return its oil to at least one of the suction line to the accumulator and to the suction line to the compressor, either with, or without, an oil return line orifice, as described above. Operation of the float will serve to limit any excessive compressor discharge gas from "short-circuiting" back into the compressor through the oil separator's oil return line, so that an oil return line orifice is preferably not necessary.

If the oil from at least one of a float-less oil separator and an oil separator with a float is returned to at least one of the accumulator and the suction line to the accumulator, the accumulator may have an interior oil return means. Typically, as is well understood by those skilled in the art, accumulators have an interior compressor suction line U bend, which U bend has a small hole (orifice) drilled through it and opened at or near its bottom (typically in or about the lower side of the bottom of the U bend). For the subject application, when oil is returned from at least one of the specially designed oil separators as disclosed herein, the orifice size for the hole at, or near, the bottom of the U bend in the suction line (within the accumulator) to the compressor, is preferably based upon compressor design capacity as per the following parameters:

An area of approximately 0.0000791 inches, plus or minus 8 approximately %, per 1,000 BTUs of compressor design capacity for design capacities between 1.5 and 2.5 tons.

An area of approximately 0.0000395 inches, plus or minus approximately 8%, per 1,000 BTUs of compressor design capacity for design capacities between 3 and 5 tons.

An area of approximately 0.0000226 inches, plus or minus approximately 8%, per 1,000 BTUs of compressor design capacity for design capacities between 5.5 and 15 tons.

Too large an orifice/hole area size can reduce superheat too low (below 1 degree F. to a point at, or too close to, saturation) and/or can permit too much liquid refrigerant into the compressor, so as to slug the compressor and/or to improperly dilute the oil pulled into the compressor bearings, and too small an orifice/hole area size can increase superheat (which is undesirable so long as superheat is above 1 degree F.) and/or can starve the compressor of adequate oil, resulting in compressor damage or burnout.

The certain orifice/hole area size in, or near, the bottom of the compressor suction line U bend within an accumulator may also have a protective screen covering with a mesh size of between approximately 600 and 700 microns so as to prevent large debris from entering and potentially damaging the compressor (600 microns is about a 30 mesh screen). As explained, a smaller mesh size could impair oil return via oil that has escaped from the oil separator and has mixed with the circulating refrigerant.

This permits the return of a mixture of refrigerant and oil from the oil separator, in addition to the very slight amount of oil that has escaped from the oil separators and is always returned in the cooling mode along with liquid refrigerant to the interior air handler/heat exchanger, and then to the accumulator, but limits the amount of refrigerant combined with any oil to a small enough amount so as not to reduce superheat to a temperature at, or below, saturation, and also prevents any excessive refrigerant return that could result in slugging the compressor or otherwise reduce system operational efficiencies.

Additionally, an extra amount of compressor lubricating oil sufficient to fill the bottom of the accumulator to a point above the orifice in the base of the U bend may be added to the accumulator when a secondary oil separator is not utilized. Otherwise, in the subject design as disclosed herein, the oil mixed within the accumulator (comprised of very small amounts oil that has escaped from the oil separator if a secondary oil separator is not utilized) could be of too thin a mixture to return to the compressor in a sufficient quantity/amount.

More than one float-less oil separator may be combined in parallel, via a distributed compressor discharge line, as necessary, and more than one oil separator with floats may be combined after each respective float-less unit, as necessary for larger tonnage systems.

Also, for triple, or greater, oil return protection, more than one oil separator with floats may be installed in series after a first float-less oil separator. This enables any oil eventually escaping the first oil separator with a float to be caught by at least a second oil separator with floats, so that any system, DX, air-source, or otherwise, could be operated almost indefinitely absent any oil return issues.

Further, recent testing has demonstrated that sufficient oil return to the system's compressor can be accomplished, even absent any oil separators, by means of super-saturating the refrigerant charge with compressor lubricating oil. Such super-saturating is accomplished via adding an additional amount of compressor lubricating oil to the system, which additional oil is in an amount, by weight of oil, at least equal to approximately 7% of the total system's refrigerant charge, by weight of refrigerant. However, the addition of such extra oil is expensive and can necessitate a larger accumulator and may, therefore, not always be preferable.

Superheat

Superheat temperatures herein will be referred to in Fahrenheit designated as "F". Maintaining a level of approximately between 1 (more than 1) to 10 degrees F. superheat, as the superheat is measured in the suction line to the system's compressor, in the heating mode is important because too low a superheat (0 or less degrees F.) can result in several concerns.

First, a superheat of 0 degrees F., as taught in U.S. Pat. No. 6,058,719 to Cochran, results in the potential of providing too much saturated refrigerant to the system's compressor. The purpose of a compressor in a refrigerant heating/cooling system is to increase the discharge temperature via increasing the pressure of a vapor (not a liquid), so as to provide the greatest possible temperature differential at efficient compressor operational power draws. If superheat is at zero (0), or below zero, or even at 1 or less, degrees F., heat is required to phase-change the portion of liquid state refrigerant into a vapor for compression by the compressor. The phase-change from a refrigerant liquid to a refrigerant vapor requires a relatively large amount of heat to be absorbed from somewhere. The heat of compression will provide ample heat to phase change any refrigerant existing in a liquid form, but at a heat energy expense, with the heat potentially coming from within the compressor itself. Heat detracted from the compressor via requisite phase change of liquid form refrigerant, at or below saturation, reduces the compressor's ability to provide the maximum temperature differential with a minimum of energy expenditure.

Additionally, if refrigerant enters the suction line to the compressor at a superheat of near 0, or less, degrees F., various other concerns may arise. One concern is that too much saturated refrigerant intake could result in too much liquid phase refrigerant in the bottom of the compressor, which could wash away too much compressor lubricating oil and shorten compressor life. In this regard, a related concern would be that operating near, or below, a 0 degree F. superheat would create a very cold oil state in the bottom of the compressor, which cold oil could tend to absorb too much refrigerant, which could result in too thin of a refrigerant/oil mixture being pulled into the compressor bearings, which could also contribute to a shortened compressor life. Further, if the compressor is too cold, the oil could thicken, enhancing the potential requirement of the use of a power-consuming and energy inefficient crankcase heater. A crankcase heater is well understood by those skilled in the art.

Another concern occasioned via operation near, or below, 0 superheat is that too much icing of the interior refrigerant transport lines and containment vessels during the heating mode of operation results. The icing is caused by moisture within the air being attracted to the very cold refrigerant transport lines and containment vessels, and then freezing. When the system cycles off, the ice melts and creates water, which is problematic in and of itself, and which also enhances mold/mildew concerns. To the contrary, too high of a superheat can result in compressor operational/discharge refrigerant vapor temperatures that are too high, can contribute to compressor burnout, and/or can decrease compressor/system life and operational efficiencies.

Therefore, in order to maximize the temperature output of the compressor with a minimum compressor energy expenditure, the superheat of the refrigerant entering the compressor may be sufficiently above zero (0) degrees F., such as at a superheat level of at least more than 1 degree F. and up to 10 degrees F.

Regarding the above-referenced U.S. Pat. No. 6,058,719 to Cochran, several other issues may be noted. First, all of Cochran's claims revolve on maintaining a heating mode superheat of at or near 0 degrees F., via providing a substantially constant amount of liquid refrigerant within the active portion of the system (within the evaporator in the heating mode), via regulating the refrigerant flow by means of a special liquid flow control device in conjunction with providing one (1) refrigerant container vessel (an accumulator) to retain inactive liquid refrigerant.

As can be readily determined via Cochran's drawings, Cochran maintains his preferred 0 degree F. superheat level in the heating mode by thoroughly mixing the refrigerant exiting the evaporator with the liquid level in the one (1) refrigerant container vessel prior to the saturated refrigerant's entry into the system's compressor. This thorough mixing is accomplished via a refrigerant transport tube exiting the system's evaporator, which enters another larger secondary tube within the one (1) refrigerant container vessel. The larger secondary tube contains an unspecified and/or unclaimed number of small holes, which small holes may be many, and which multiple small holes may allow enough liquid phase refrigerant to thoroughly mix with and/or remove any remaining superheat from the refrigerant (the refrigerant entering the refrigerant containment vessel from the evaporator) within the specially designed "mixing chamber" design. Next, the fully saturated refrigerant is permitted to travel around a liquid deflection shield and enter the suction line to the system's compressor in at least one of a fully saturated and a multiple tiny particulate liquid form.

The refrigerant, exiting the one refrigerant containment vessel and entering the suction line to the compressor, via Cochran's design, may be in a highly saturated form, very close to, or just below ("just below" is "near") zero degrees F. superheat, in order to return necessary compressor lubricant oil to the compressor, as Cochran provides/discloses/teaches no other possible means of compressor lubricant oil return. As is well understood by those skilled in the art, compressors generally always contain a lubricant oil in a sufficient quantity to mix with the circulating refrigerant and to be returned, along with liquid phase refrigerant, via an orifice in or near the bottom of a U bend in the suction line to the compressor, which suction line, via its U bend within the accumulator, runs through the liquid refrigerant and oil mixture within the lower portion of a conventional accumulator. As compressor oil does not evaporate under the temperature/pressure conditions of the refrigerant in a heat pump system, as is well understood by those skilled in the art, the oil may be returned, in conjunction with at least one of liquid and saturated refrigerant fluid, to the system's compressor, or the compressor will burn out.

Thus, of necessity, particularly in conjunction with Cochran's earth tap heat exchanger, and particularly since Cochran does not teach the addition of any extra oil to the system at any location, Cochran must maintain a close to zero, or near zero (lower than 0 degrees, for example is near 0 degrees), superheat level exiting the system's evaporator, and exiting the system's one (1) refrigerant containment vessel, in order to achieve adequate necessary compressor lubricant oil return. Thus, Cochran's subject design is realistically limited to system operational designs where a 0, or close to 0 (slightly less than 0, for example), degree F. superheat is maintained exiting the evaporator, and exiting the one (1) refrigerant containment vessel, in the heating mode, or the system's compressor could burn out due to lack of adequate oil return.

It is respectfully noted that Cochran does state that "For example, the superheat is preferably maintained to less than five degrees Fahrenheit, more preferably less than one degree Fahrenheit, and most preferably at about zero degrees." (See column 6, lines 13-16.) However, as explained above, Cochran solely claims a system operating at or near 0 degrees F. superheat in the evaporator, and Cochran's design must, of necessity, have very close to 0, or less, degrees F. (with a temperature lower than zero, such as −1 degree F., still being "near" 0 degrees F.) exiting both the evaporator and the one (1) refrigerant containment vessel in order to effect necessary lubricant oil return to the system's compressor, particularly as no extra oil is taught to be added to the system.

Cochran fails to teach how to either design or operate a system where there is more than close to 0 degree(s) superheat exiting the evaporator and/or exiting the one (1) refrigerant container vessel, so as to effect compressor lubricant oil return to the compressor under such conditions. Cochran also fails to teach how to maintain compressor suction superheat levels of more than 1 and up to 10 degrees F.

Additionally, regarding Cochran's design, the one refrigerant containment vessel would, of necessity, retain more refrigerant in the heating mode than in the cooling mode, as is well understood by those skilled in the art, and would, therefore, require at least two sight glasses, or the like, to ascertain the correct refrigerant charge level in each respective mode. Further, when Cochran's design would be utilized in conjunction with an earth tap heat exchanger (a direct exchange sub-surface geothermal heat exchanger), when one seasonally switched from the heating mode to the cooling mode, having only one refrigerant containment vessel filled with a large amount of saturated and cold liquid refrigerant (typically at or below 32 degrees F. under such conditions) would worsen the ability of the system to functionally operate until the ground sufficiently warmed up so as to supply between 42 and 52 degrees F. refrigerant to the interior heat exchanger. Testing has shown that when the refrigerant entering the interior heat exchanger is below about 44 to 52 degrees F., in the cooling mode, the interior heat exchanger will/can frost, which materially decreases operational efficiencies (typically due to a restriction of design airflow). The frosting of the interior air handler coils is caused by circulating refrigerant at temperatures at, or below, freezing after passing through the refrigerant expansion device to the interior air handler (expansion devices usually lower temperatures by about 12 to 20 degrees F., as is well understood by those skilled in the art). How to overcome such a dilemma is neither taught nor disclosed by Cochran.

Maintaining a level of more than 1 and up to 10 degrees F. superheat, as the superheat is measured in the suction line to the system's compressor, is accomplished by means of providing a special operational design. Generally, a level of more than 1 and up to 10 degrees F. superheat can be maintained via utilization of a system wherein:

(1) The discharge of the refrigerant fluid supplied into the accumulator, via a mostly vapor refrigerant fluid supply/suction line, may be delivered into the accumulator below the liquid refrigerant level in the accumulator via a fully opened distal ended supply line and/or by means of adequately sized holes which are in situated in the side of the supply line and which holes are situated below the liquid level in the accumulator. The exiting open distal end, and/or or side holes in the tubing/line with a cross sectional area equivalent to the cross section open area of the open distal end, of the system's suction line to the accumulator may be extended below a permanently maintained liquid refrigerant level within the accumulator, so that the return refrigerant fluid may travel through liquid state refrigerant prior to its entry to the vapor suction line to the compressor itself, which compressor vapor suction line exits at the top of the accumulator and travels to the compressor.

However, any side holes, just above a capped distal end of the accumulator supply tube, may be limited in number so that the side holes have respective areas no smaller than one-tenth of the total area of the full open distal end of the vapor supply line to the accumulator. If the side holes, even with the same resulting total area, are too small, the mixing of the vapor with the liquid can become too great and saturation of the refrigerant fluid delivered to the compressor can result.

If side holes are supplied near, but above, the distal end of the refrigerant supply/suction line to the accumulator, in a manner so that the holes are always below the liquid level in the accumulator, the area equivalency of the open distal end of the suction line is measured, and between two and ten holes may then optionally be drilled in the wall of the tube, so that the total number of holes will always have at least the total area equivalency of the distal end of the refrigerant supply/suction line if it were fully opened. Testing has shown that such a minimum/maximum open area, and/or such a limited hole number and area equivalency, provides refrigerant vapor bubbles of sufficient quantity and of adequate size to maintain a superheat greater than 1 and up to 10 degrees F. superheat, without resulting in too much saturated refrigerant being pulled into the system's compressor, and all while retaining a satisfactorily low superheat level that helps to enhance at least one of operational efficiencies and compressor life. As an example where the lower distal end of the line may be capped, and holes are drilled in the sides of the line just above the cap, remaining at a level below the liquid refrigerant within the accumulator, there would be ten holes with respective areas of 0.044 square inches each in the side of a supply line that had a total interior area of 0.44 inches (a ¾ inch I.D. refrigerant transport tube). It is also entirely permissible to leave the distal end of the tube open and also provide appropriate holes (so long as no more than 10 holes) in the side, so that if the lower distal end of the tube should become blocked (such as being accidently extended all the way to the bottom of the accumulator with no adequate refrigerant exit gap), there would always be adequate refrigerant sully to the accumulator.

(2) The oil from at least one of a specially designed oil separator, without a float, may be returned to at least one of the suction line to the accumulator and the suction line to the compressor through an oil return line containing a filter and a pin restrictor with an orifice area size as explained/disclosed above. In the alternative, oil from a specially designed oil separator with a float could be utilized alone, or in conjunction with a float-less oil separator, as explained/disclosed above, with the oil being returned from the oil separator containing a float directly to at least one of the suction line to the compressor and to the suction line to the accumulator, which accumulator has an appropriately sized orifice, with a protective screen, in its interior U bend compressor suction line, as explained above.

This permits the return of a mixture of refrigerant and the very slight amount of oil (that has escaped from the oil separator) to the compressor, but limits the amount of refrigerant combined with any oil to a small enough amount so as not to reduce superheat to a temperature at, very near to, or below, saturation, and also prevents any excessive refrigerant return that could result in slugging the compressor or otherwise reduce system operational efficiencies.

Further, while Cochran's said invention intentionally has no receiver (see column 3, line 16 of the U.S. Pat. No. 6,058,719), testing has shown the incorporation of a specially designed receiver, in conjunction with the other disclosures contained herein, can provide several advantages. Specifically, the incorporation of a specially designed receiver, for use in conjunction with the subject disclosures, permits the use of at least only one sight glass to ascertain a proper refrigerant level within the accumulator and, more importantly, affords the majority of extra liquid refrigerant to enter the sub-surface heat exchanger of a direct exchange geothermal system, when one switches from the heating mode to the cooling mode, in an approximate 70 to 80 degree F. warm condition, rather than in an approximate otherwise near, or below, freezing condition.

Such a specially designed receiver may be installed within the liquid refrigerant line exiting the system's condenser in the heating mode. The specially designed receiver, used in conjunction with the special accumulator disclosed herein, may be designed to contain 0.267 pounds of refrigerant per 1,000 BTU system size design, with system sizing performed as per ACCA Manual J, or the like, which sizing criteria is well understood by those skilled in the art.

Such a receiver design partially shares the charge differential (among the heating and cooling modes) between the sub-surface refrigerant transport tubing (varying designs of which are well understood by those skilled in the art) and the interior air handler (which is well understood by those skilled in the art) with the special accumulator, as herein described. A one-size receiver containment vessel/tank, designed to service 1 to 5 ton system designs would facilitate manufacturing.

Such a one containment vessel/tank size receiver tank could be designed to hold a maximum of 16 pounds of refrigerant to service 1 through 5 ton system designs. The appropriate refrigerant content design within the receiver tank, for varying system tonnage (1 ton equals 12,000 BTUs) sizes, could easily be modified to accommodate varying liquid refrigerant content capacities for the varying system BTU capacity designs by simply adjusting (raising to provide more capacity, and lowering to provide less capacity) the lower open distal end of the liquid refrigerant transport line that transports liquid refrigerant, exiting the receiver in the heating mode, to the heating mode expansion device, with the heating mode supply refrigerant transport line always entering the receiver at the bottom of the receiver tank.

The incorporation of such a receiver permits one to utilize at least only one sight glass, or the like, in the system's accumulator so as to ascertain a correct system refrigerant charge (as opposed to multiple sight means in Cochran's aforesaid design), and also, more importantly, permits one to immediately provide a significant quantity of warmed (typically 70 to 80 degree F.) refrigerant into the ground when switching from the heating mode to the cooling mode of system operation, thereby materially helping the ground surrounding the sub-surface heat exchange tubing to reach a temperature warm enough so as to provide 47 degree F. to 52 degree F. refrigerant exiting the ground, so that cooling mode operation, in conjunction with the cooling mode expansion device (cooling mode expansion devices are well understood by those skilled in the art), does not result in undue frosting of the interior heat exchanger. An interior heat exchanger is typically an air handler comprised of a fan and finned refrigerant transport tubing, as is well understood by those skilled in the art.

Lastly, Cochran's invention calls for the evaporator to be constantly fully flooded and to contain an essentially constant amount of refrigerant (see column 3, lines 19-24 of the U.S. Pat. No. 6,058,719). Factually, under the subject disclosure of Wiggs, it is not preferable to ever fully flood the evaporator, and the amount of refrigerant within the evaporator will vary, depending upon varying indoor/outdoor and/or sub-surface temperature conditions. Under the subject disclosure of Wiggs, the design combinations provide extremely high operational efficiencies, all while only ever filling the sub-surface evaporator, in the heating mode of a DX geothermal system, to points typically between 18% and 25% of the total sub-surface vapor refrigerant transport/evaporator line content capacity. In the cooling mode, under the subject disclosure of Wiggs, the interior evaporator, in the cooling mode, will typically never be filled more than about 50% to 75%. However, as aforesaid, via the subject and disclosed design disclosures by Wiggs herein, the superheat entering the compressor will still be maintained within the desirable rage of more than 1 and up to 10 degree F. range.

Higher Discharge Temperature

A higher discharge temperature can be obtained by means of utilizing at least two compressors. The first compressor discharges its hot gas into the suction line of a second compressor. Such cascading compressors are well known in the art. However, they have never before been utilized in a DX system application because of compressor lubricant oil return concerns. The oil return designs as described herein will provide adequate oil return to both compressors, even if the oil rejection rate of one compressor is not exactly the same as the other (although both the compressors may have similar refrigerant mass flow rates). However, the oil separator may be placed within the second compressor's hot gas discharge line (the first compressor directly feeds the second compressor), and the oil return line from the oil separator may be placed in at least one of the suction line to the accumulator and in the suction line to the first compressor.

As an alternative to utilizing at least one special oil separator, cascading compressors in a DX system may optionally be utilized with a super-saturated compressor oil charge, where the extra oil added by weight is equal to at least 7% of the system's total refrigerant charge weight.

Insulation within a DX Well/Borehole System

In order to at least one of optimize system operational efficiencies and to minimize system costs, testing has demonstrated an improved means of providing an optimum amount of insulation on the liquid refrigerant transport line within a well/borehole DX system design application.

Namely, while fully insulating the smaller diameter liquid refrigerant transport line within a well/borehole DX system design application has been disclosed by Wiggs in U.S. Pat. No. 6,932,149, further testing has demonstrated that at least 18% of the larger diameter vapor refrigerant transport line within a well/borehole DX system design application is typically always filled with liquid refrigerant when the system is properly charged.

This means that phase change of the refrigerant from a vapor to a liquid has already occurred in the cooling mode at a point within at least the upper 82% of the well/borehole depth (the well/borehole contains the sub-surface geothermal heat exchange tubing loop), with at least the lower 18% portion of the well/borehole providing refrigerant sub-cooling. Similarly, this means that phase change of the refrigerant from a liquid to a vapor has already occurred in the heating mode at a point within at least the lower 18% of the well/borehole depth (the well/borehole contains the sub-surface geothermal heat exchange tubing loop), with at least the upper 82% portion of the well/borehole providing refrigerant superheat. Sub-cooling and superheat respectively represent heat below and above the saturation temperature of the refrigerant, as is well understood by those skilled in the art.

Consequently, as a result of the subject test findings, it has been found preferable not to insulate the lower approximate 15% to 18% portion of the smaller diameter liquid refrigerant transport line within the geothermal heat exchange well/borehole, so as to provide more geothermal superheat in the heating mode, and so as to provide more geothermal sub-cooling in the cooling mode near the bottom of the well/borehole where the ground temperature remains the most stable, all without any material "short-circuiting" heat transfer among the two respective cool liquid and warm vapor refrigerant transport lines within the same well/borehole.

The above-disclosed liquid content portions of the vapor line within a well/borehole DX system apply when one utilizes a ¾ inch O.D. refrigerant grade vapor line and a ⅜ inch O.D. refrigerant grade liquid line. The percentages will proportionately vary when differing sized liquid and vapor line tubing is utilized. However, in all cases, the liquid refrigerant transport line may be fully insulated, but never to more than the maximum point of the liquid level of refrigerant within the lower portion of the sub-surface vapor heat exchange line.

Lastly, when utilizing foam type insulation materials to surround non-heat transfer refrigerant transport lines, testing has shown one may utilize at least an approximate ½ inch thick wall, closed cell, foam insulation to surround the insulated portion of the liquid refrigerant transport line, so as to adequately inhibit a "short-circuiting" loss of geothermal heat gain in the heating mode, and heat loss in the cooling mode, via natural conductive heat transfer, due to the immediate proximity of the cool liquid line and the warm vapor line within the same well/borehole in a vertically oriented well/borehole DX system design. Testing has demonstrated that an approximate ½ inch thick insulation wall is preferable because: (1) adequate insulation is provided to prevent material "short-circuiting"; (2) there is less than an 8% degradation of temperature over using a ¾ inch thick insulated wall; (3) a ½ inch thick wall is easier to store, ship, and install on pre-manufactured and spooled loops of liquid and vapor line for insertion into pre-drilled wells/boreholes; and (4) when a well/borehole is drilled in a high water table, less weight is required to be added to the liquid and vapor line loop to offset the buoyancy of the insulation, thereby facilitating a less expensive and faster installation.

Universal and DX System Applications

The subject designs regarding oil separation and superheat, as explained herein, can be advantageously utilized in any refrigerant based heat pump system, whether air-source, water-source, or DX.

As maintaining a superheat level of more than 1 and up to 10 degrees F. is highly advantageous for reasons explained herein, the utilization of a specialized accumulator with an accumulator suction line return situated below the refrigerant liquid level in the accumulator, and with a specially designed/sized oil and liquid refrigerant return orifice in the base of the U bend of the suction line within the accumulator leading to the compressor, will be highly advantageous for any heat pump system, not just for a DX system operation. However, in a DX system, the advantages of such an accumulator design can be maximized because of a DX system's unique ability to always provide relatively cool incoming vapor from the evaporator, particularly in the heating mode.

Also, the unique oil return designs disclosed herein, which enables a DX system to operate at depths beyond 100 feet (herein referred to as a Deep Well DX system design, or a "DWDX" system) in the heating mode without fear of inadequate oil return, can be utilized in any conventional heat pump system, and would have very practical applications for split-system air-source heat pumps (which conventional heat pump systems are all well understood by those skilled in the art), especially where material vertical rises/falls are mandated between at least one of interior and exterior heat exchanges.

However, certain designs disclosed herein are unique to DX system applications, such as insulating all but the lowest approximate 15% to 18% portion of the liquid refrigerant transport line within a well/borehole, and such as the ability to utilize cascading compressors in a DX system application via the newly disclosed compressor lubricant oil return designs as set forth herein.

DETAILED DESCRIPTION

The following detailed description is of the best presently contemplated mode of carrying out the subject matter disclosed herein. The description is not intended in a limiting sense, and is made solely for the purpose of illustrating the general principles of this subject matter. The various features and advantages of the present disclosure may be more readily understood with reference to the following detailed description taken in conjunction with the accompanying drawings.

Figures 1, 2:
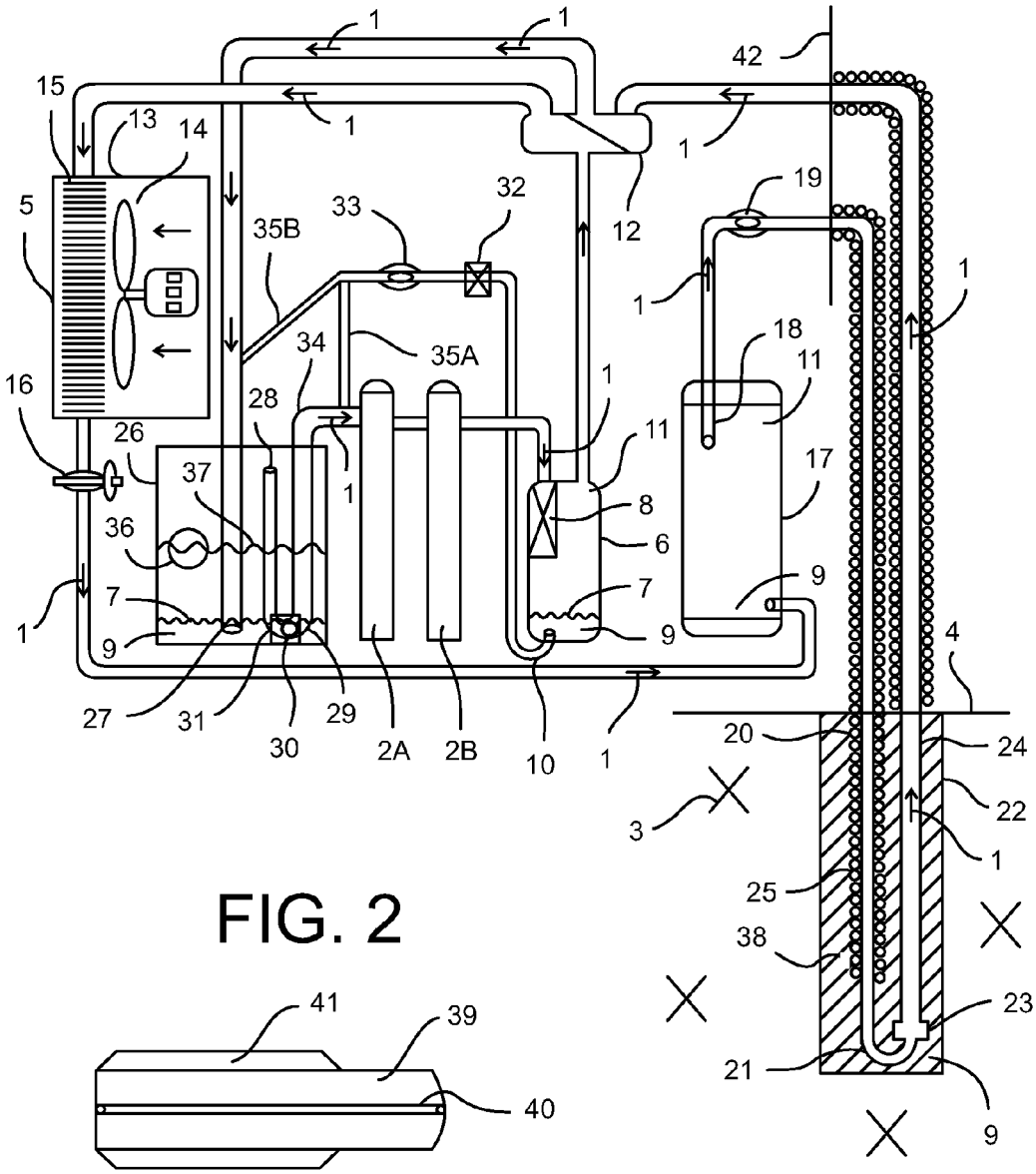
FIG. 1 is a side view of a DX geothermal heating/cooling system incorporating primary accumulator, cascading compressors, receiver, oil return means, pin restrictor, and insulated ground loop teachings of the present disclosures.
FIG. 2 is a side view of a pin restrictor.

Referring now to the drawings in detail, where like numerals refer to like parts or elements, there is shown in FIG. 1 a side view, not drawn to scale, of a DX geothermal heating/cooling system incorporating the above-described disclosures.

Refrigerant is not shown, but the directional travel of the refrigerant, in the heating mode, is indicated by arrows 1 within refrigerant transport tubing (refrigerant liquid transport tubing is shown as 21, and refrigerant vapor transport tubing is shown as 24). Here, two compressors, 2A and 2B are shown, with the first compressor 2A discharging its hot refrigerant gas into the second compressor 2B, where the pressure and temperature of the refrigerant receives a secondary boost, so as to provide a greater heat transfer temperature differential in the ground 3, below the ground surface 4, in the cooling mode (not shown, as same would be well understood by those skilled in the art), and so as to provide a greater heat transfer temperature differential in the air handler 5 in the heating mode (operation in the heating mode is shown herein via directional refrigerant flow arrows 1). The greater the temperature differential of any heat exchanger, the greater the efficiency, so long as the energy expenditure to create the greater temperature differential is less than the energy required to provide the greater temperature differential. While two compressor 2A and 2B are shown herein, the same design can be utilized with more than two compressors 2A and 2B, so long as each respective compressor directly feeds the other respective compressor, with the final compressor discharging its hot gas into the oil separator 6, and so long as the lubricant oil (not shown) from the last compressor (herein shown as compressor 2B, is returned to the first compressor (herein shown as compressor 2A).

As the hottest refrigerant exits the second compressor 2B, it travels into the oil separator 6, where the oil (not shown except for an oil level 7) is separated by a highly efficient oil filter 8 within the oil separator 6 and falls to the bottom portion 9 of the oil separator 6, where it is continuously and ultimately returned, by means of an oil transport line 10, to the two respective compressors 2A and 2B. The oil mixed with the hot gas discharge of the first compressor 2A provides oil return to the second compressor 2B. One will note there is no float, which float is generally always found in oil separators, as is well understood by those skilled in the art, thereby eliminating the problems/concerns attendant with floats and their hinges.

As disclosed hereinabove, the oil separator 6 may be optionally eliminated if one elects to super-saturate the refrigerant flow 1 with extra oil. The extra oil (not shown) may preferable be in an oil weight amount equal to at least 7% of the weight of the full system's refrigerant 1 charge.

With the oil separated from the refrigerant, as shown herein, the refrigerant 1 flows out of the top portion 11 of the oil separator 6 into a reversing valve 12 (reversing valves are well understood by those skilled in the art). In the heating mode, as shown herein, the refrigerant 1 is shown herein as next flowing into the interior heat exchanger 5, here comprised of an air handler 5. Air handlers 5 are well understood by those skilled in the art and are basically comprised of a fan 14 (the unmarked arrows adjacent to the fan 14 simply indicate airflow dirction) and finned refrigerant transport tubing 15 within abox 13.

After exiting the air handler 5, the refrigerant 1 flows through an air handler 5 TXV refrigerant expansion device 16, which is inactive in the heating mode (air handler 5 TXV refrigerant expansion devices are well understood by those skilled in the art). After exiting the TXV 16, the refrigerant 1 flows into the bottom portion 9 of a receiver 17. The receiver 17 may fill up with liquid refrigerant 1 in the heating mode before the warm (approximate 70 to 80 degree F.) liquid refrigerant 1 exiting the air handler 5 can exit through the refrigerant transport tube segment 18 in the top portion 11 of the receiver 17. Thus, a specifically designed portion of the refrigerant 1 charge differential between the heating and the cooling mode can be automatically retained in the receiver 17. The specially designed receiver 17, used in conjunction with the special accumulator 26 disclosed herein, as previously disclosed herein, may be designed to contain about 0.267 pounds of refrigerant per 1,000 BTU system size design, with system sizing performed as per ACCA Manual J, or the like, which sizing criteria is well understood by those skilled in the art.

One receiver 17 containment/tank size can be provided for multiple system sizes by simply adjusting the extension level of the liquid refrigerant transport tube segment 18 within the receiver 17, which tube segment 18 conducts liquid refrigerant 1 out of the receiver 17 and into the heating mode expansion device 19. The higher the tube segment 18 is positioned within the receiver 17, the greater the amount of liquid refrigerant 1 that will be retained in the receiver 17, and the lower the tube segment 18 is positioned within the receiver 17, the less the amount of refrigerant 1 that will be retained in the receiver 17.

After exiting the receiver 17, the refrigerant 1 next travels through a heating mode expansion device 19, here shown as a pin restrictor heating mode expansion device 19. Pin restrictor expansion devices 19 are well understood by those skilled in the art. After leaving the heating mode expansion device 19, the refrigerant 1 is reduced in pressure and temperature so as to be able to absorb naturally occurring geothermal heat from below the ground surface 4.

In the heating mode, the refrigerant 1 enters the ground 3 through a smaller diameter liquid refrigerant transport line 20, which line 20 forms a U bend 21 in the bottom portion of a well/borehole 22, and is coupled to a larger diameter vapor refrigerant transport line 24. The un-insulated below-ground surface 4 portion of the vapor line 24 is utilized for geothermal heat transfer, as is the lower approximate 18% (not drawn to scale) of the un-insulated liquid line 20. The full upper approximate 82% (not drawn to scale) portion of the below-ground surface 4 portion of the liquid line 20 is fully insulated 25 with a closed-cell foam insulation 25 comprised of at least a preferable approximate one-half inch thick wall insulation 25. While not insulating the lower approximate 18% of the liquid refrigerant transport line 20 within the well/borehole 22 is described here, not insulating between approximately 15% and approximately 18% (not drawn to scale) of the of the liquid refrigerant transport line 20 within the well/borehole 22 is an acceptable tolerance. As is well understood by those skilled in the art, the empty annular space (not shown) within the well/borehole 22 may be filled with a heat conductive fill material 38 (typically a grout, such as a preferable cementitious Grout 111) in order to achieve effective geothermal heat transfer.

As the refrigerant 1 exits above the ground surface 4, in the heating mode, both the vapor line 24 and the liquid line 20 are both shown as being fully insulated 25 to a structural wall 42. Within and inside the wall 42, in all interior spaces (other than within the air handler 5), all refrigerant transport lines are fully insulated (not shown herein), as is a common good practice well understood by those skilled in the art. Once through the structural wall 42, the refrigerant 1 then travels through the reversing valve 12 and into the specially designed accumulator 26. The vapor refrigerant transport line 24 extends into the bottom portion 9 of the special accumulator 26, to a point so as to always be below the fluctuating liquid refrigerant level 37 continuously maintained within the accumulator 26. The bottom distal open end 27 of the vapor line 24 within the accumulator 26 is left fully open so that the refrigerant 1 vapor naturally bubbles up (not shown) through the liquid refrigerant 37 within the accumulator 26 to a point above the liquid refrigerant level 37, where refrigerant 1 fluid with a superheat greater than one and up to ten is then pulled into the open end 28 of the suction line 34 ultimately leading to the first compressor 2A.

Even though the liquid refrigerant level 37 maintained within the accumulator 26 fluctuates, depending on interior air (not shown) temperatures and ground 3 temperatures, since there is a liquid refrigerant receiver 17 specially designed to contain the approximate difference in charge between the heating mode and the cooling mode, only one sight glass 36 (sight glasses are well understood by those skilled in the art) can be placed in the accumulator 26 so as to insure adequate system refrigerant 1 charge in both the heating mode and the cooling mode. The sight glass 36 can be placed in the accumulator 26 at a location that will permit viewing of the liquid refrigerant level 37 in the accumulator 26 upon initial system charging when the ground 3 is at relatively constant temperature in either the heating mode or the cooling mode, so that adequate initial refrigerant 1 charge can be visually insured in either operational mode via only one sight glass 36.

As the low superheat refrigerant 1 travels through the suction line 34 to the first compressor 2A, it may travel through a suction line U bend 29 with a small orifice/hole 30 in the base portion of the U bend 29, which orifice/hole 30 may be designed within certain specific sizing criteria, as explained hereinabove. Additionally, the orifice/hole 30 may be covered with a specially sized netting/screening 31 to prevent debris (not shown) from being pulled out of the liquid refrigerant 37 into the first compressor 2A. The specially sized orifice/hole 30 permits any oil (not shown) that has escaped from the oil separator 6 to be returned to the first compressors 2A, and then to the second compressor 2B, and provides just enough liquid refrigerant 37 to lower the superheat of the refrigerant 1 being pulled into the first compressor 2A, without lowering the superheat to a temperature level that is too low, such as close to, or at, zero degrees superheat.

Additionally, testing has shown that in order for the refrigerant/oil mixture not be too thin on oil content, due to the relatively large volume of liquid phase refrigerant 37 always contained within the specially designed accumulator 26, additional compressor lubricating oil may be added to the accumulator 26, prior to initial system start-up, in an amount so as to cover the top of the small orifice/hole 30 in the base of the U bend 29 within the accumulator 26. Here, an appropriate oil level 7 is shown within the accumulator 26, as being above the small orifice/hole 30.

As previously mentioned, the oil exiting the oil separator 6 travels through an oil transport line 10. The oil first travels through a preferable small oil filter 32 to remove any tiny debris that could block the ultimate return flow of oil to the first compressor 2A. The oil next travels through the specially sized, as disclosed/explained hereinabove, oil pin restrictor orifice 33. The pin restrictor orifice 33, as shown herein, could be comprised of a simple, and similarly sized, orifice in a wall/plate (not shown herein), or a similarly sized capillary tube (not shown herein), or the like. As the oil exits the oil pin restrictor orifice 33, it next travels to at least one of the suction line 34 to the first compressor 2A, via the compressor oil return line 35A, and to the vapor line 24, (also here acting as the suction line to the accumulator 26) via the accumulator oil return line 35B. The oil optionally may be returned to the suction line 34 to the first compressor 2A, via the compressor oil return line 35A, because the hot oil will vaporize any one degree, or less, superheated refrigerant 1 being pulled into the first compressor 2A, and will materially assist in preventing condensate ice (not shown) from building up on the suction line 34 to the first compressor 2A. However, oil return directly to the suction line 34 of the first compressor 2A will increase compressor (2A and 2B) superheat.

Adequate oil return is also achieved by returning the oil to the vapor line 24 (here also acting as the suction line to the accumulator 26) via the accumulator oil return line 35B. In such event, no significant temperature gain advantage is achieved in the vapor line/suction line 34 leading to the first compressor 2A, so as to increase the temperature of any possible refrigerant at or below one degree F. superheat, and so as to assist in preventing condensate ice build up on the suction line 34 to the first compressor 2A. However, with the continuous hot oil return from the oil separator 6 being directed into the accumulator 26, compressor (2A and 2B) superheat will be lowered, which is typically preferable over simply avoiding some potential icing/frosting.

FIG. 2 is a side view of a common pin restrictor 39, which, as well as its housing (not shown herein), is well understood by those skilled in the art. The pin restrictor 39 sits within a housing (not shown, but well understood by those skilled in the art) that permits refrigerant flow around the exterior of the pin 39, past its fins 41, as well as through its central orifice 40, when the system is operating in the opposite of the pin's 39 intended respective heating or cooling mode of operation. However, when the pin 39 functions in its intended mode of operation, refrigerant (not shown herein) is forced to flow solely through the central orifice 40 in the pin 39. Pin restrictors 39 are routinely utilized as refrigerant expansion devices, but have never historically been used as a design to control the oil return flow from an oil separator (not shown herein, but shown as 6 in FIG. 1) with no float.

Figure 3:
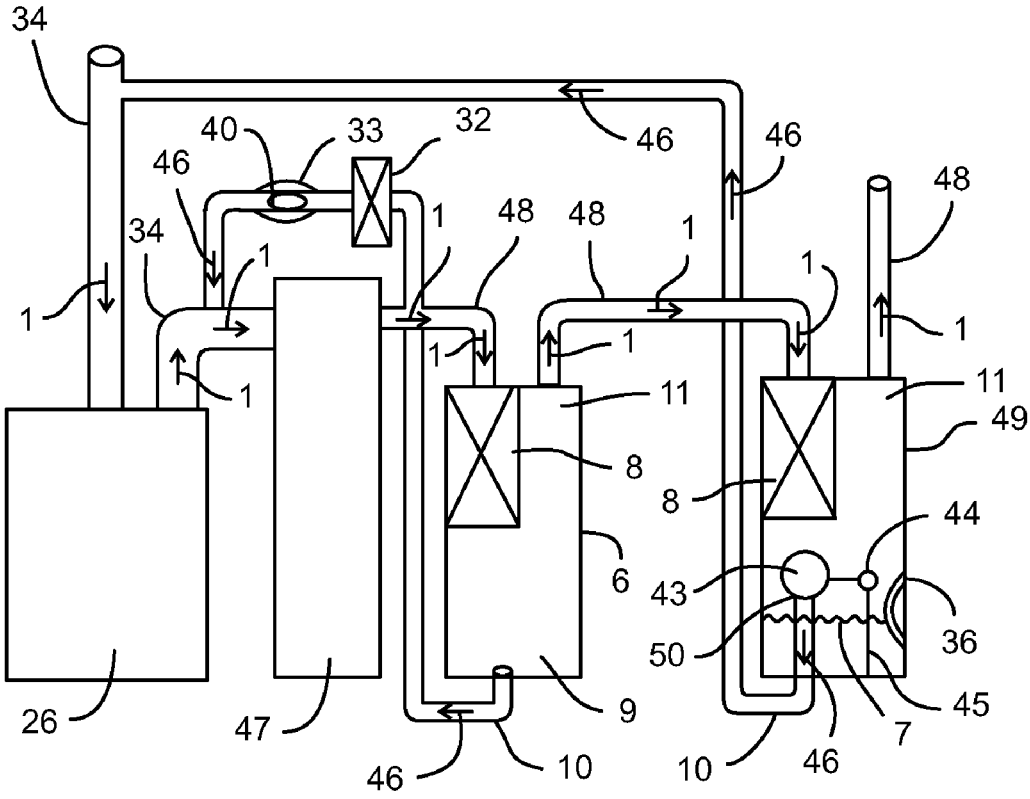
FIG. 3 is a side view of an accumulator, a compressor, and two oil separators, with the first oil separator being float-less and feeding refrigerant/oil to a second oil separator, which contains a float.

FIG. 3 is a side view of a single compressor 47 that discharges its hot, high pressure gas (not shown, but refrigerant flow directional arrows 1 depict the direction of refrigerant flow) and oil mixture (not shown at this point) through a high pressure refrigerant transport line 48 into a first oil separator 6, containing no interior float. An extremely efficient (at least approximately ninety-eight percent efficient) filter 8, within the first oil separator 6, separates the oil and the refrigerant 1 exiting the compressor 46. The filter 8 is preferably at least one and a half the size of a conventionally sized filter 8 for the same tonnage system. The oil drops to the bottom portion 9 of the first oil separator 6 with no interior float, where it is continuously pulled, during system operation, into the suction line 34 to the compressor 47 via an oil transport/return line 10. Within the oil transport line 10, the directional travel of the oil is shown by oil flow directional arrows 46. While the oil 46 from the first oil separator 6 is shown herein as being pulled into the suction line 34 to the compressor 47, as shown in FIG. 1 above, the oil could alternatively be pulled into the suction line 34 to the accumulator 26, which is preferred when a lower compressor 47 superheat is desirous.

On its way to the compressor 47 from the first float-less oil separator 6, the oil may pass through a small oil filter 32 and then through the small orifice pin restrictor 33 within the oil transport/return line 10 between the first float-less oil separator 6 and the suction line 34 to the compressor 47. The small orifice pin restrictor 33 is designed and sized so as to solely permit oil flow ultimately back to the compressor 47, absent any, or any significant, refrigerant flow. However, the orifice 40 within the pin restrictor 33 is so small that only a tiny bit of debris could block the return oil flow 46. Consequently, a small oil filter 32, comprised of appropriately sized screening, or the like (of a preferable mesh sizing as disclosed hereinabove), may be placed within the oil transport/return line 10 prior to the oil 46 traveling into the small orifice pin restrictor 33.

Once the filter 8 in the first float-less oil separator 6 separates the refrigerant and the oil, the oil drops (not shown) to the bottom portion 9 of the separator 6 and travels into an oil transport/return line 10, and the refrigerant exits through the top portion 11 of the first separator 6 into the high pressure refrigerant transport line 48 leading into a second oil separator 49.

The second oil separator 49 contains a float 43, that is seated on top 50 of an oil transport/return line 10. Here, the float 43 is shown as seated because the oil level 7 is shown as below the float 43, to permit room for the very slight amount of oil leaking from the first float-less oil separator 6 to accumulate before the float 43 is lifted via the displacement weight of accumulated oil slightly leaking out of the first float-less oil separator 6. The float 43 is able to move up and back down by means of a hinge 44, which hinge 44 is secured by a solid support 45. The refrigerant 1 exiting the second oil separator 49, also exits from the top portion 11 of the second oil separator 49 and travels on its way into the rest of the system (not shown herein).

The oil exiting the second oil separator 49, when the float 43 is lifted above its seat at the top 50 of the oil transport/return line 10 within the second oil separator 49, travels to the suction line 34 to the accumulator 26. Here, since there is a float 43 within the second oil separator 49, sealing off the top 50 of the oil transport/return line 10 when the oil level 7 remains below the float 43, there is not a requirement to provide only enough flow rate for the returning oil (with the oil flow direction indicated by arrow 46) so as to permit oil flow only and not any, or at least not any significant, refrigerant vapor flow within the oil transport/return line 10, as has been alternately shown via the small orifice pin restrictor 33 within the oil transport/return line 10 between the first float-less oil separator 6 and the suction line 34 to the compressor 47. In fact, the continuous oil flow 46 from the second oil separator 49 would be so small, the use of a float 43 in the second oil separator 49 is preferable.

A sight glass 36 (which is well understood by those skilled in the art, is placed in the side wall of the second oil separator 49 so as to be able to ascertain the oil level 7 within the second oil separator 49 is at an appropriate design level The refrigerant 1 finally exits the second oil separator 49 through the top portion 11 of the second oil separator 49 into the high pressure refrigerant transport line 48 leading into the rest of the system (not shown).

The subject oil return means can be used with any heat pump system, DX, air-source, or otherwise, whenever adequate compressor oil return is a concern.

What is claimed is:

1. A direct exchange geothermal heat pump system comprising:

refrigerant tubing including a liquid tubing coupled to a vapor tubing, a sub-surface portion of the liquid tubing together with a sub-surface portion of the vapor tubing defining an exterior geothermal heat exchanger;

a refrigerant disposed in the refrigerant tubing and having a refrigerant weight;

a first compressor having a first compressor suction line fluidly communicating with the refrigerant tubing and a first compressor discharge line;

an interior heat exchanger disposed in the refrigerant tubing and having a first end fluidly communicating with first compressor discharge line and a second end fluidly communicating with the exterior geothermal heat exchanger;

an initial oil charge equal to a factory recommended volume of oil for the first compressor; and an extra oil charge having a weight of at least 7% of the refrigerant weight.

2. The direct exchange geothermal heat pump system of claim 1, further comprising a second compressor having a second compressor suction line fluidly communicating with the first compressor discharge line, and a second compressor discharge line, in which the interior heat exchanger first end fluidly communicates with the second compressor discharge line, and in which the initial oil charge is equal to a factory recommended volume of oil for both the first and second compressors.

3. The direct exchange geothermal heat pump system of claim 1, further comprising an accumulator having an accumulator inlet fluidly communicating with the refrigerant tubing and an accumulator outlet fluidly communicating with the first compressor suction line.

4. The direct exchange geothermal heat pump system of claim 3, in which the accumulator holds a volume of liquid refrigerant, and in which a portion of the vapor tubing extends into the accumulator to define a distal open end disposed below a surface of the volume of liquid refrigerant.

5. The direct exchange geothermal heat pump system of claim 1, further comprising:

an oil separator having a top portion defining an inlet fluidly communicating with the first compressor outlet and a bottom portion configured to collect oil;

an oil return line communicating between the accumulator and the oil separator; and a fixed orifice pin restrictor disposed in the oil return line, the fixed orifice pin restrictor having a pin size diameter sized according to a compressor capacity as follows:

for compressor capacities up to 12,000 BTU, the pin size diameter is equal to approximately 0.003225 inches for each 1,000 BTU of compressor capacity; and for compressor capacities above 12,000 BTU, the pin size diameter is equal to approximately 0.039 inches plus approximately 0.000216 inches for each 1,000 BTU of compressor capacity above 12,000 BTU.

6. The direct exchange geothermal heat pump system of claim 1, in which the sub-surface portion of the liquid tubing and the sub-surface portion of the vapor tubing extend substantially vertically.

7. The direct exchange geothermal heat pump system of claim 1, in which the exterior geothermal heat exchanger extends at least 100 feet below a ground surface.

8. The direct exchange geothermal heat pump system of claim 1, in which the interior heat exchanger comprises at least one of an air handler and a refrigerant to water heat exchanger.

9. A direct exchange geothermal heat pump system comprising:

refrigerant tubing including a liquid tubing coupled to a vapor tubing, a sub-surface portion of the liquid tubing together with a sub-surface portion of the vapor tubing defining an exterior geothermal heat exchanger;

a refrigerant disposed in the refrigerant tubing;

an accumulator having an accumulator inlet fluidly communicating with the refrigerant tubing and an accumulator outlet;

a first compressor having a first compressor suction line fluidly communicating with the accumulator and a first compressor discharge line;

an initial oil charge equal to a factory recommended volume of oil for the first compressor;

an oil separator having a top portion defining an inlet fluidly communicating with the first compressor outlet and a bottom portion configured to collect oil, the oil separator further having a refrigerant outlet, the oil separator being configured to separate at least approximately 98% of entrained oil from the refrigerant;

an oil return line fluidly communicating between the oil separator bottom portion and the first compressor suction line;

an interior heat exchanger disposed in the refrigerant tubing and having a first end fluidly communicating with the refrigerant outlet of the oil separator and a second end fluidly communicating with the exterior geothermal heat exchanger;

a U bend disposed in the accumulator and fluidly communicating with the first compressor suction line, the U bend including a base portion defining a hole; and an additional oil charge disposed in the accumulator and having a volume sufficient to submerge the hole in the base portion of the U bend.

10. The direct exchange geothermal heat pump system of claim 9, further comprising a second compressor having a second compressor suction line fluidly communicating with the first compressor discharge line, and a second compressor discharge line, in which the oil separator inlet fluidly communicates with the second compressor outlet, and in which the initial oil charge is equal to a factory recommended volume of oil for both the first and second compressors.

11. The direct exchange geothermal heat pump system of claim 9, in which the oil separator comprises an oil filter having an efficiency of at least approximately 98%.

12. The direct exchange geothermal heat pump system of claim 9, in which the oil return line communicates directly between the oil separator bottom portion and the first compressor suction line.

13. The direct exchange geothermal heat pump system of claim 9, in which the oil return line communicates directly between the oil separator bottom portion and the accumulator.

14. The direct exchange geothermal heat pump system of claim 9, in which the sub-surface portion of the liquid tubing and the sub-surface portion of the vapor tubing extend substantially vertically.

15. The direct exchange geothermal heat pump system of claim 9, in which the exterior geothermal heat exchanger extends at least 100 feet below a ground surface.

16. The direct exchange geothermal heat pump system of claim 9, in which the accumulator holds a volume of liquid refrigerant, and in which the vapor tubing extends into the accumulator to define a distal open end disposed below a surface of the volume of liquid refrigerant.

17. The direct exchange geothermal heat pump system of claim 9, further comprising:

a fixed orifice pin restrictor disposed in the oil return line, the fixed orifice pin restrictor having a pin size diameter sized according to a compressor capacity as follows:

for compressor capacities up to 12,000 BTU, the pin size diameter is equal to approximately 0.003225 inches for each 1,000 BTU of compressor capacity; and for compressor capacities above 12,000 BTU, the pin size diameter is equal to approximately 0.039 inches plus approximately 0.000216 inches for each 1,000 BTU of compressor capacity above 12,000 BTU.

* * * * *